US007064713B2

(12) United States Patent
Koenig

(10) Patent No.: US 7,064,713 B2
(45) Date of Patent: Jun. 20, 2006

(54) MULTIPLE ELEMENT PATCH ANTENNA AND ELECTRICAL FEED NETWORK

(75) Inventor: Mary K. Koenig, Seattle, WA (US)

(73) Assignee: Lumera Corporation, Bothell, WA (US)

( * ) Notice: Subject to any disclaimer, the term of this patent is extended or adjusted under 35 U.S.C. 154(b) by 0 days.

(21) Appl. No.: 10/972,127

(22) Filed: Oct. 22, 2004

(65) Prior Publication Data

US 2006/0055604 A1 Mar. 16, 2006

Related U.S. Application Data

(60) Provisional application No. 60/609,729, filed on Sep. 14, 2004.

(51) Int. Cl.
*H01Q 1/38* (2006.01)

(52) U.S. Cl. ..... 343/700 MS; 343/850

(58) Field of Classification Search ..... 343/700 MS, 343/850, 853; 342/371, 354
See application file for complete search history.

(56) References Cited

U.S. PATENT DOCUMENTS

| | | | | |
|---|---|---|---|---|
| 4,903,033 | A | 2/1990 | Tsao et al. | 343/700 MS |
| 5,166,690 | A | 11/1992 | Carlson et al. | 342/157 |
| 5,166,693 | A | 11/1992 | Nishikawa et al. | 342/422 |
| 5,220,335 | A | 6/1993 | Huang | 343/700 MS |
| 5,243,358 | A | 9/1993 | Sanford et al. | 343/836 |
| 5,872,547 | A | 2/1999 | Martek | 343/815 |
| 6,046,701 | A | 4/2000 | Carey et al. | 343/753 |
| 6,147,658 | A | 11/2000 | Higashi et al. | 343/853 |
| 6,169,525 | B1 | 1/2001 | Dziadek et al. | 343/911 R |
| 6,268,828 | B1 | 7/2001 | Martek | 342/373 |
| 6,509,883 | B1 * | 1/2003 | Foti et al. | 343/850 |
| 6,531,985 | B1 | 3/2003 | Jones et al. | 343/702 |
| 6,689,809 | B1 * | 2/2004 | Ahotupa et al. | 514/473 |
| 6,788,268 | B1 | 9/2004 | Chiang et al. | 343/850 |
| 6,897,808 | B1 * | 5/2005 | Murch et al. | 343/700 MS |
| 6,911,939 | B1 * | 6/2005 | Carson et al. | 343/700 MS |
| 6,975,267 | B1 * | 12/2005 | Stenger et al. | 342/371 |

* cited by examiner

*Primary Examiner*—Don Wong
*Assistant Examiner*—Huedung X. Cao
(74) *Attorney, Agent, or Firm*—Fish & Richardson P.C.

(57) ABSTRACT

A feed network for coupling elements of a multi-element patch antenna to transmit or receive circuitry may include segments having dimensions that maximize the impedance of the feed network. Increasing the feed network impedance can simplify matching of the feed network to conventional transmission line impedances (e.g., 50 Ohms, 75 Ohms), which reduces reflections of the operating signals as a result of impedance mismatches. By designing the feed network as a hierarchical distribution network of transmission lines of particular lengths selected to maximize impedance, signal reflections may be reduced and bandwidth of the antenna system may be improved.

33 Claims, 13 Drawing Sheets

Exemplary Feed Networks

Single Element with Low Impedance Length of Transmission Line A-B

Single Element with Additional Line Length with a High Impedance

Single Elements with Low Impedance length of Transmission Line A-B

Single Element with Additional Line Length with a High Impedance

Three Elements Combined in a Column

Three Elements Combined in a Column and Rotated with a Length of Line

Final, Three Columns of Three Elements Combined

Three Element Combiner Dimensions on 28 mil Substrate - Dimensions in mils

MULTIPLE ELEMENT PATCH ANTENNA AND ELECTRICAL FEED NETWORK

CROSS REFERENCE TO RELATED APPLICATIONS

This application claims priority from U.S. Provisional Application. No. 60/609,729, filed Sep. 14, 2004, and titled "Patch Antenna Assembly," which is incorporated by reference in its entirety.

TECHNICAL FIELD

This invention relates to electrical network elements that may be coupled to patch antennas.

BACKGROUND

Antennas are used in communication systems to send and receive information using electromagnetic waves. Systems that use antennas include short-range communication links for wireless networks, such as Wireless Fidelity (WiFi), cellular phone, or Bluetooth, for example. Some antenna systems are designed primarily for receiving broadcast signals transmitted from great distances, such as cellular towers or communication satellites, for example. In some applications, the functionality provided by a quality antenna system may be incorporated into devices such as laptop computers, positioning systems, handheld computing devices, industrial controllers, local area networks (LANs), and many other devices.

As devices are reduced in physical size, antenna systems are needed that are compact enough to be integrated into smaller and smaller devices. Some types of antenna designs are more suitable for integration into the housings of common electronic devices, such as laptops or computer peripheral devices. One type of antenna suitable for some of these applications is a patch antenna.

A patch antenna may be implemented, for example, as one or more conductive areas, or patches, on a printed circuit board. Patches may have any suitable geometric shape, including rectangles, circles, triangles, or bow ties. Multiple patches may be laid out in an array. The geometric shape and layout of the patches determine how the antenna will perform in terms of beam pattern and beam width. Generally speaking, a multi-element patch antenna will have a narrower beam width than a single element patch antenna.

For a given multi-element patch antenna, the performance of the antenna when coupled to receive or transmit circuitry depends on the patch antenna's bandwidth. The bandwidth of an antenna is a measure of its ability to operate over a specified range of frequencies. Unlike some antenna properties, bandwidth does not have a universally accepted and unique definition, in part because the bandwidth may depend on operational requirements of the antenna. However, a wide bandwidth antenna generally has good performance over a wider range of frequencies than a narrow bandwidth antenna. Bandwidth may be affected by factors such as input impedance, signal loss, antenna pattern, and standing wave ratio (SWR) on the antenna's feed network. A feed network for a patch antenna provides an electrically conductive path between transmit or receive circuitry and the elements of the patch antenna.

Accordingly, the feed network that couples the elements of the antenna to the transmit or receive circuitry plays a significant role in determining the effective bandwidth of the antenna in the overall system. As such, an important element in the design of a multi-element patch antenna system is the design of the feed network.

SUMMARY

A feed network for coupling elements of a multi-element patch antenna to transmit or receive circuitry may include segments having dimensions that maximize the impedance of the feed network. Increasing the feed network impedance can simplify matching of the feed network to conventional transmission line impedances (e.g., 50 Ohms, 75 Ohms), which reduces reflections of the operating signals as a result of impedance mismatches. By designing the feed network as a hierarchical distribution network of transmission lines of particular lengths selected to maximize impedance, signal reflections may be reduced and bandwidth of the antenna system may be improved.

In one aspect, an electrical network for coupling transmit or receive circuitry to a multi-element patch antenna includes a first group of electrically conductive segments in which each segment is connected at one end to a different one of the patch antenna elements and is connected at an opposite end to a common electrical node. Each segment has a predetermined length designed such that, for a desired wavelength of a signal that propagates in parallel through the segments, the signal forms in each segment a standing wave in which a maximum value of the peak voltage amplitude occurs at the common node. The electrical network also includes a second electrically conductive segment that is connected at one end to the common node. The second segment is formed such that a signal that propagates along the second segment is split substantially equally among each of the segments in the first group.

In an embodiments of the electrical network, the predetermined length of each segment in the first group is the sum of 1) a minimum length at which the minimum value of the peak voltage amplitude occurs in a standing wave of the desired wavelength, and 2) a length that is an odd integer multiple of one-quarter the desired wavelength.

In other embodiments, each of the electrically conductive segments of the first group and the electrically conductive second segment each include a conductive trace. The conductive traces and patch antenna elements may be attached to a print circuit board, or alternatively, attached to a flexible dielectric substrate. The lengths of each of the segments in the first group may be substantially equal.

In still other embodiments, the first group of segments may include three segments. The segments may be sized and positioned such that a signal propagating in the second segment splits substantially equally among the three segments. A middle one of the three segments may be wider than the other two segments. A signal that propagates along the second segment may be coupled from the second segment to the middle one of the three segments primarily by electric field coupling. A signal that propagates along the second segment may be coupled from the second segment to the other two of the three segments primarily by magnetic field coupling.

In still another embodiment, the electrical network may also include one or more additional groups of electrically conductive segments. Each additional group may have two or more segment that are each connected at one end to a different one of the patch antenna elements and are each connected at an opposite end to a corresponding common electrical node associated with that additional group. Each segment in that additional group may have a predetermined length such that, for a desired wavelength of a signal that propagates in parallel through the segments in that additional group, the signal forms in each segment a standing wave in which a maximum value of the peak voltage amplitude occurs at the common node associated with that additional group. The electrical network may also include one or more additional electrically conductive segments uniquely corresponding to each one of the additional groups of segments. Each additional segment may be connected at one end to the common node corresponding to that additional group and formed such that a signal that propagates along the additional segment in that additional group is split substantially equally among each of the segments in that additional group.

In various further embodiments, the electrical network may be part of a multi-element patch antenna receiver system or a multi-element patch antenna transmitter system. Alternatively, the electrical network may be part of a multi-element patch antenna system having a bandwidth of 200 MHz at 2.44 GHz, or being characterized by 12 dBi directivity, 7 dBi gain, or 45 degree beamwidth for an array of 3×3 elements.

In another aspect, a patch antenna includes multiple patch antenna elements and an electrical network to couple the patch antenna elements to transmit or receive circuitry.

In embodiments, the electrical network may be designed to provide a characteristic impedance to the transmit or receive circuitry of about 75 Ohms, or between about 50 and about 75 Ohms. The electrical network may be designed to have an impedance that is maximized using conventional printed circuit board design limits for trace-to-trace spacing and trace width. The conventional printed circuit board design limits may include a minimum trace width of about 0.004 inches, and/or a minimum trace-trace spacing of about 0.006 inches.

In other embodiments of the patch antenna, the bandwidth of the antenna may be at least 100 MHz. The multiple patch antenna elements comprise four elements. The four elements may each be coupled to a different one of the segments in the first group.

In further embodiments, the patch antenna of claim may also include second and third electrical networks. As such, the multiple patch antenna elements may have nine antenna elements. The nine elements may be interconnected such that a first group of three antenna elements is coupled to the electrical network, a second group of three elements is coupled to the second electrical network, and a third group of three elements is coupled to the third electrical network. The second electrically conductive segments in each of the electrical networks may be designed to have a predetermined length that is the sum of 1) a minimum length from the common node in that electrical network at which a minimum value of the peak voltage amplitude occurs in a standing wave of the desired wavelength, and 2) a length that is an odd integer multiple of one-quarter the desired wavelength.

Certain embodiments may have one or more advantages. For example, increased bandwidth may enable improved antenna performance over a wider band of frequencies. By allowing segment to be made of advantageous lengths, a common segment may be split into any practical number of segments at nodes within the feed network. The appropriate design of segment lengths and electromagnetic coupling also allow signals to be split substantially equally into 2, 3, 4 or more parallel segments of substantially equal impedance in the feed network. Such a feed network may couple to any practical number of antenna elements in a multi-element patch antenna array. The feed network can also be structured to maximize apparent impedance at the frequency of interest, and may be designed intuitively with the aid of a Smith chart.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A feed network for coupling elements of a multi-element patch antenna to transmit or receive circuitry may include segments having dimensions that maximize the impedance of the feed network. Increasing the feed network impedance can simplify matching of the feed network to conventional transmission line impedances (e.g., 50 Ohms, 75 Ohms). Improved impedance matching may reduce signal reflections that can cause signal loss and limit bandwidth. By designing the feed network so that signal reflections may be reduced over a range of frequencies of interest, bandwidth of the antenna system may be improved.

Accordingly, a feed network for a multi-element patch antenna may be designed to increase bandwidth by designing segments of the feed network to have particular lengths that will maximize impedance of the feed network for a desired wavelength of signal. The lengths of the feed network segments may be determined, for example, by using a Smith chart.

A feed network may include conductive traces that form a hierarchical distribution network of transmission lines. Such a feed network may be implemented as a pattern of conductive traces on a printed circuit substrate, such as a printed circuit board (PCB) or a flexible conductive circuit (FCC). Such a hierarchical distribution network may include one or more nodes (or junctions) at which one trace splits into two or more traces.

In various embodiments, a high impedance feed network may achieve advantages, such as increased bandwidth, for multi-element patch antenna systems that have an arbitrary number of elements. Examples of multi-element patch antennas that may be fed by a high impedance feed network include arrays of the following sizes: 2×1, 2×2, 3×1, 3×2, 3×3, 4×1, 4×2, 4×3, 4×4, and may further include arrays of m×n elements (where m=1, 2, 3 . . . , and n=1, 2, 3 . . . ). In some embodiments that use conventional fabrication processes, a practical limit on the number and arrangement of patch antenna elements that may be fed by the high impedance network may be the highest practically achievable impedance line that may be realized for a trace or segment of the feed network.

Figure 1C:
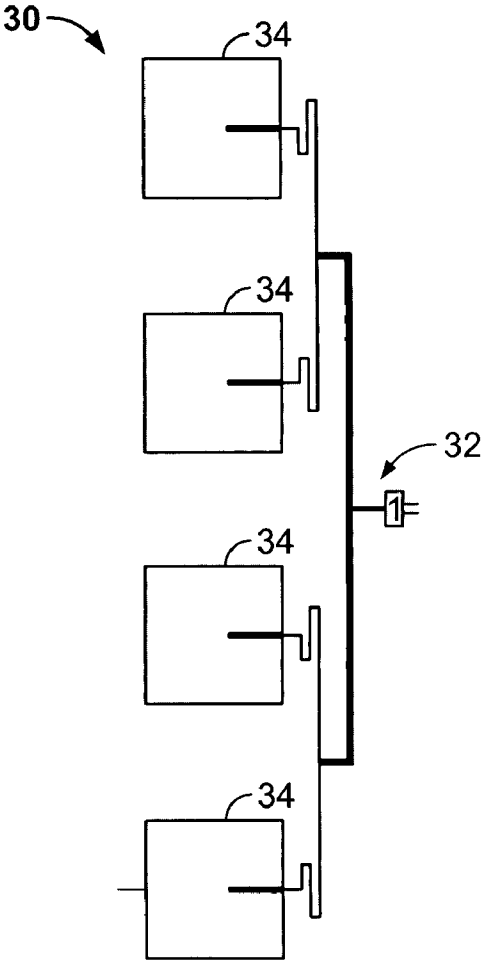
FIGS. 1A–1C are layout diagrams of various exemplary multi-element patch antennas each coupled to a feed network.
Figure 1B:
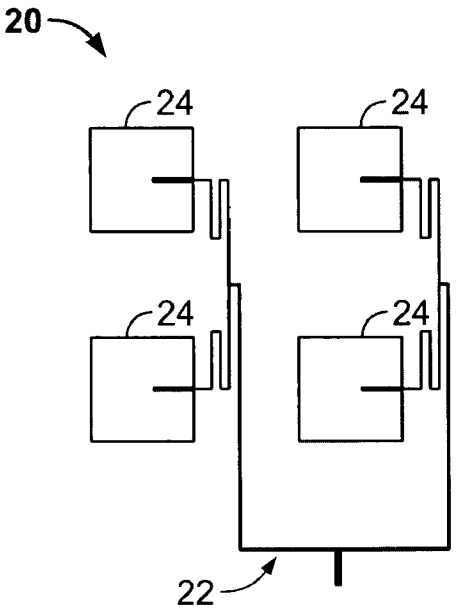
Figure 1A:
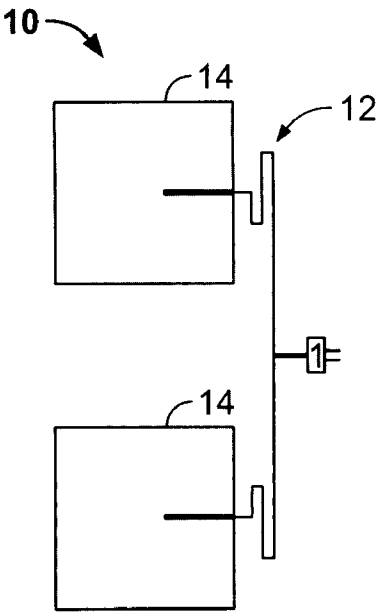

In FIGS. 1A–1C, three exemplary multi-element patch antennas 10, 20, 30 embody arrays of various sizes. Each multi-element patch antenna 10, 20, 30 includes a high impedance feed network 12, 22, 32, respectively, configured to provide wide bandwidth performance. The high impedance feed networks 12, 22, 32 are examples of hierarchical distribution networks that are designed in accordance with the methods and principles that are described in detail below. Each feed network 12, 22, 33 is arranged to feed patch antenna elements 14, 24, and 34 respectively.

Feed Network Design Procedure

Antenna systems that use multi-element patch antennas may operate at high frequencies, such as, for example, 800 MHz in a cellular telephony system, or 2.4–2.48 GHz in a WiFi system. At such high frequencies, the lengths of typical traces on a PCB, for example, can be a significant fraction of, or even exceed, one wavelength of the signal. As such, a trace on a PCB may be modeled as a transmission line for purposes of analyzing signals that propagate through a multi-element patch antenna feed network.

Modeled as a transmission line, a trace on a PCB has a characteristic impedance that is determined, in part, by material properties, such as resistivity of the trace metal (e.g., copper, gold, etc . . . ) and permittivity of the dielectric substrate (e.g., conventional PCB dielectric materials such as FR4 or CEM). Geometric factors, such as trace thickness and width, spacing between the traces and the patch antenna element, and other conductive structures (e.g., to ground plane layer, if provided), may also affect the characteristic impedance of a trace.

Discontinuities in the characteristic impedance along a transmission line may cause an incident propagating signal to be partially reflected. Impedance discontinuities may occur, for example, at a junction where the signal splits into two or more paths. The magnitude and sign of the reflected signal may be a function of the complex impedances on either side of the impedance discontinuity.

For a signal having a particular wavelength and propagating along a transmission line that includes an impedance discontinuity, the vector sum of the incident and reflected signals may change along the transmission line. This changing vector sum corresponds to a standing wave that repeats itself every half wavelength along the transmission line. The amplitude and phase of this vector sum uniquely determines the apparent impedance at any point along the transmission line.

Consequently, the apparent impedance at any point along the transmission line is a function of the distance from the next impedance discontinuity, and more particularly, a function of where within one of the repeating half wavelengths along the standing wave the point falls. For example, if the point falls on a peak of a standing wave of voltage, the apparent impedance will be at a maximum point. Conversely, if the point falls on a trough of the standing wave of voltage, the apparent impedance will be at a minimum point.

A convenient tool for graphically analyzing complex impedances along a transmission line is a Smith chart. In general, a Smith chart can aid the analysis and design of transmission lines. The chart is a polar representation of constant resistance and reactance curves that are normalized to the characteristic impedance ($z_0$). The Smith chart can include a wavelength scale plotted around the perimeter of the chart to indicate distance along a transmission line in terms of the electrical wavelength. One complete revolution around the circle corresponds to one-half electrical wavelength. Rotating around the chart in one direction corresponds to moving the indicated number (or fractional number) of wavelengths toward the generator end of the transmission line, and rotating the opposite direction corresponds to moving the indicated number (or fractional number) of wavelengths toward the load end of the transmission line.

The center of the chart corresponds to the characteristic impedance ($z_0$) being resistive, or $z=1+j0$. A resistance axis, which indicates the resistive component of the impedance, passes through this center point and bisects the circle. The resistance axis represents zero resistance at one intersection with the perimeter of the circle, and infinite resistance at the opposite intersection with the perimeter of the circle. Accordingly, one half of the resistance axis is referred to herein as being in the "low impedance" half of the circle, and the other half of the resistance axis may be referred to herein as being in the "high impedance" half of the circle.

Although a Smith chart is not required to practice the invention, it is used herein for purposes of illustration and explanation. Other tools, such as calculators, computers, finite element analysis programs, and the like, may be used to practice the preferred embodiment and associated methods.

Exemplary Feed Network for Single-Element Patch Antenna

Figure 2A:
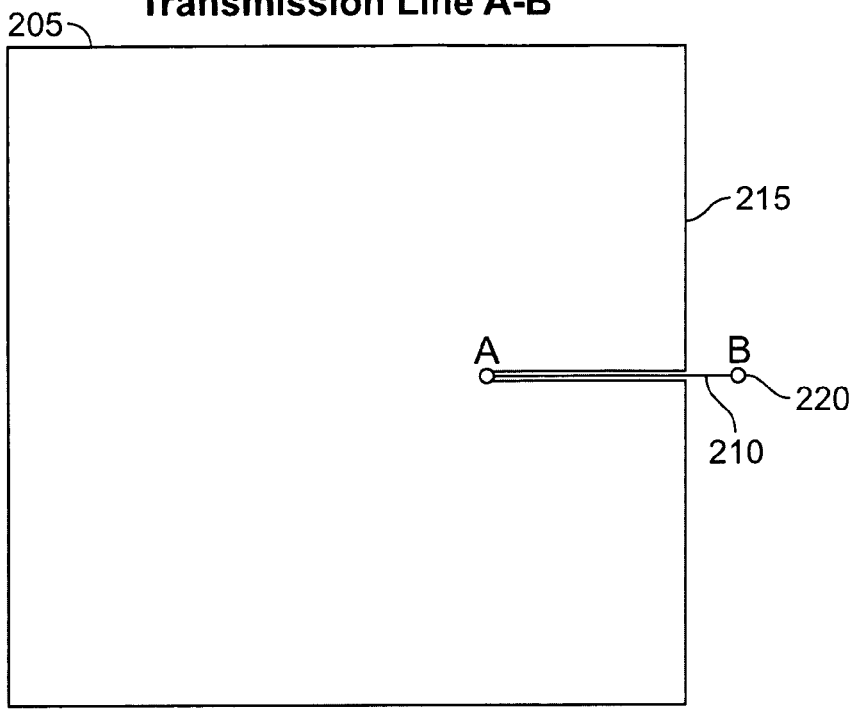
FIG. 2A is a layout diagram for a single patch antenna element fed by a low impedance segment.
Figure 2B:
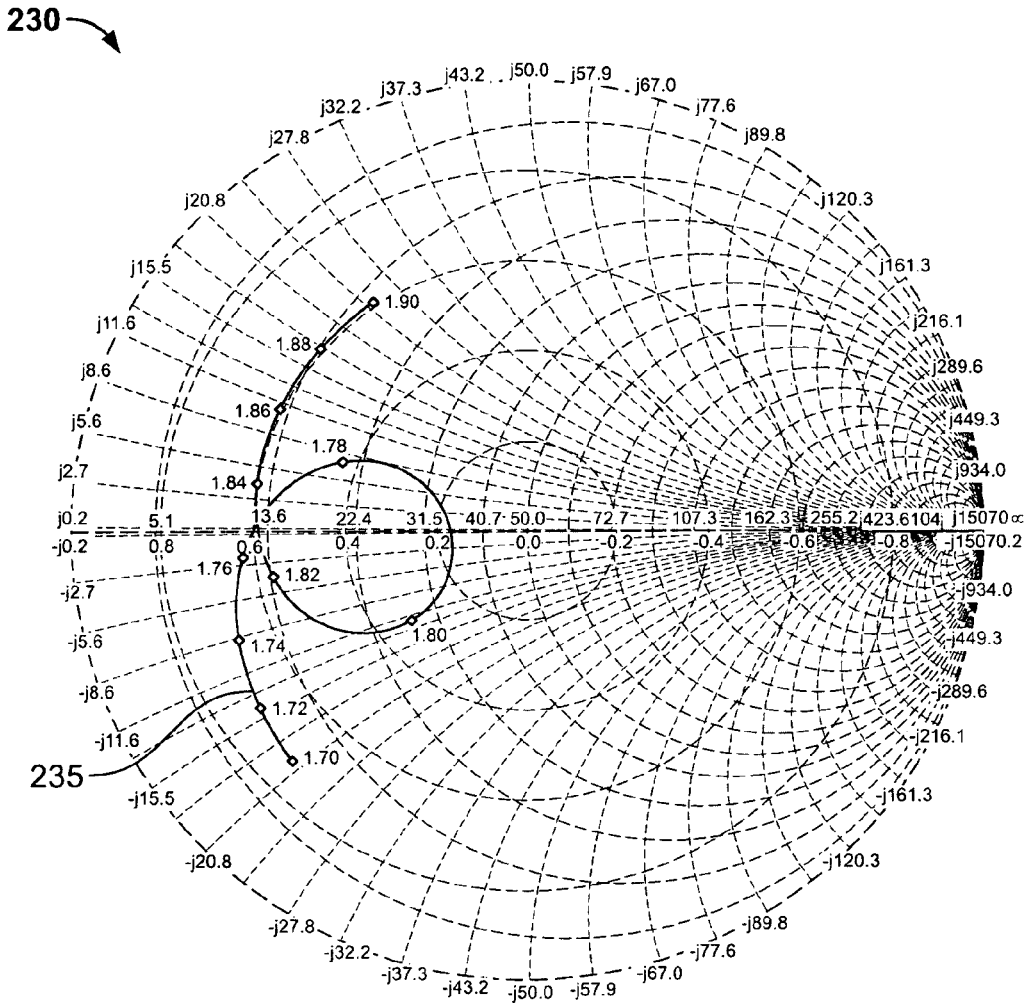
FIG. 2B is a Smith chart plot of the impedance of the segment of FIG. 2A.

The use of a Smith chart to plot the impedance of a length of trace connected to a single patch antenna element is illustrated in FIGS. 2A–2B. In FIG. 2A, a patch antenna element 205 is fed by a segment 210. The segment 210 connects to the patch antenna element 205 at point A 215. The segment 210 ends at a point B 220 to define a segment of length A-B.

In FIG. 2B, a Smith chart 230 includes a plot 235 of the complex impedance as measured at point B 220 over a range of frequencies. In this example, the plot 235 traverses the Smith chart 230 in correspondence with a range of frequencies from 1.70 to 1.90 GHz. The complex impedance values may be determined at intermediate frequencies by either simulation or by actual measurement. In this example, the complex impedance plot 235 crosses the resistive axis on the low impedance side of the Smith chart 230 multiple times over the plotted frequency range.

In one example, a high impedance multi-element patch antenna feed network may be designed as follows. Starting with a patch element, a segment of the feed network is directly connected to the patch element. The segment, which for purposes of explanation will be described as a trace, is made to have a maximum practical characteristic impedance value.

For example, a feed network may be laid out on a printed circuit board using conventional layout and design rules. In one example, minimum conventional trace width may be 4 mils (i.e., 0.004 inches). In other examples, even narrower trace widths may be used to provide a relatively high characteristic impedance trace. In various embodiments, trace-to-trace spacing may be set, for example, to a conventional value of 6 mils (i.e., 0.006 inches). In some embodiments, each antenna element may be connected at a point substantially near the center of the patch to the feed network through, for example, a 4 mil wide trace. The trace may be designed to be spaced 6 mils from the conductive area of the patch (except, of course, where the trace makes contact near the center of the patch).

With the high impedance geometry of the trace determined, the trace may be laid out to have a specific length. The specific length is a function of the wavelength of the signal at the operating frequency of the antenna, and it is the sum of two components. In terms of the Smith chart, a first component (A-B) of the length may determined by the length of that trace at which the apparent impedance first crosses the resistive axis on the low impedance side of the Smith chart. The second component of the length adds a length (B-C) at which the apparent impedance crosses the resistive axis on the high impedance side of the Smith chart. The total length of the trace (A-C) may be laid out to be straight, or it may weave back and forth in a circuitous manner.

Figure 3A:
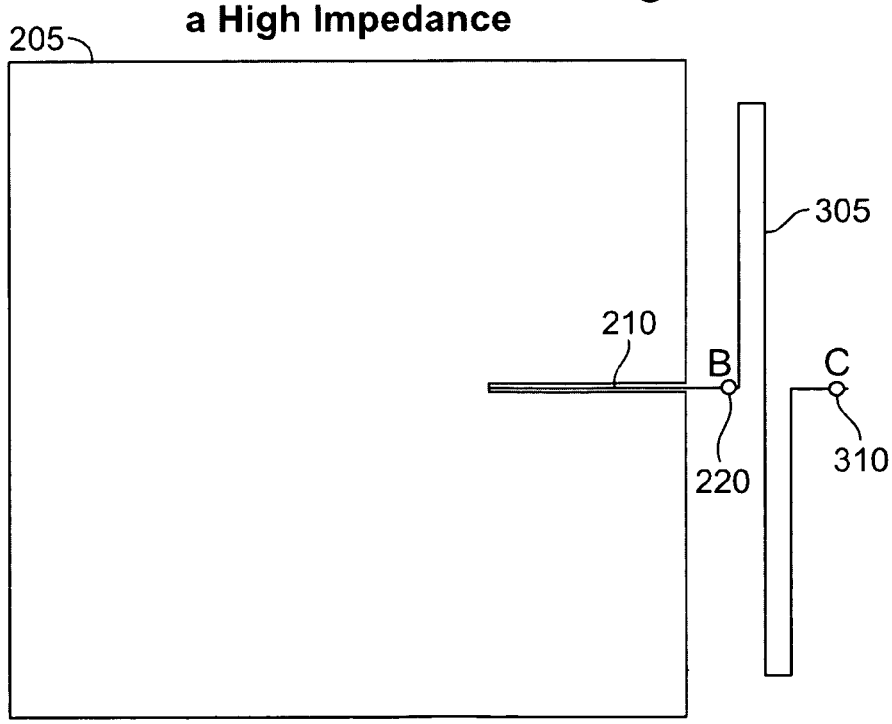
FIG. 3A is a layout diagram for a single patch antenna element fed by a high impedance segment.

As shown in FIG. 3A, the impedance changes when an additional length B-C 305 is added to the length A-B of the segment 210. The additional length 305 extends the segment from point B 220 to point C 310.

Figure 3B:
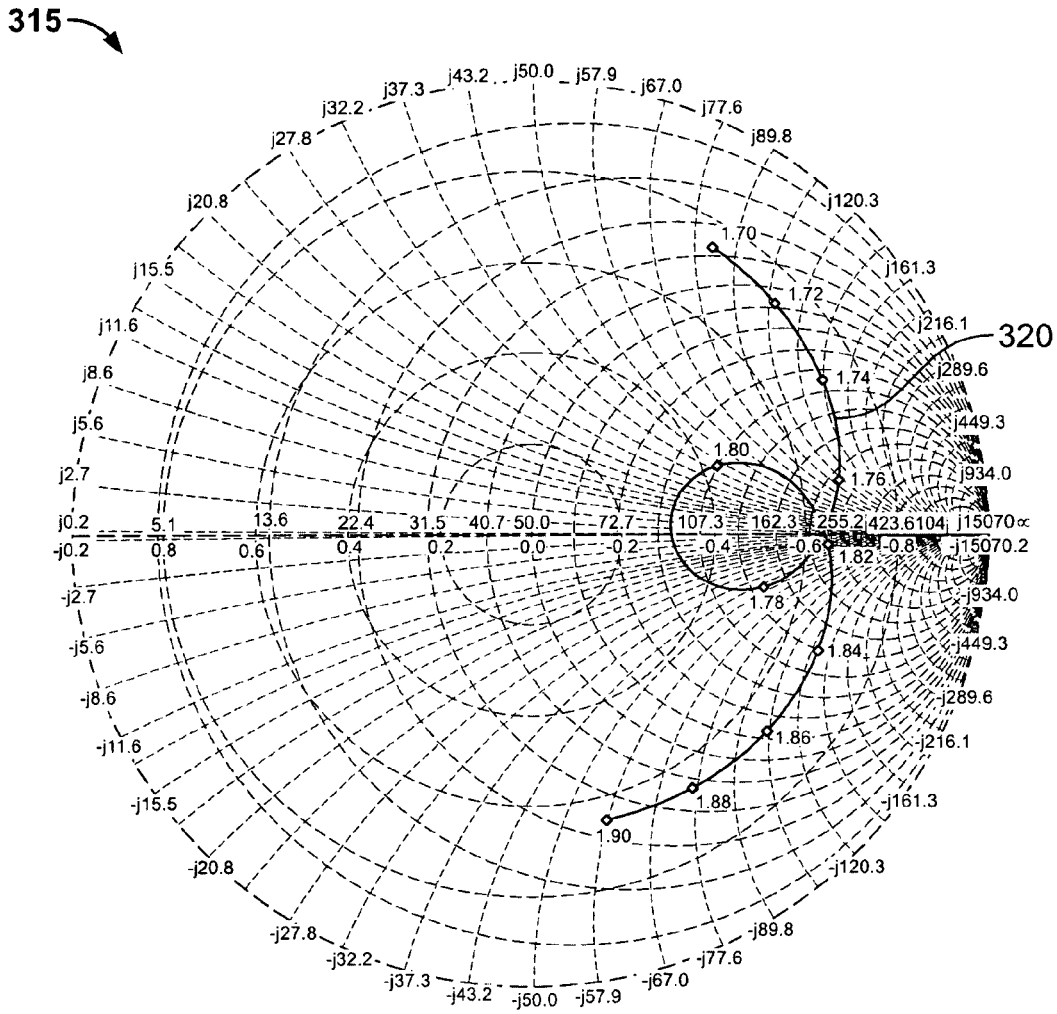
FIG. 3B is a Smith chart plot of the impedance of the segment of FIG. 3A.

In FIG. 3B, a Smith chart 315 includes a plot 320 of the complex impedance as measured at the point C 310 over a range of frequencies. The plot 320 traverses the Smith chart 315 in correspondence with a range of frequencies from 1.70 to 1.90 GHz. The complex impedance values may be determined at intermediate frequencies by either simulation or by actual measurement. In this example, the complex impedance plot 320 crosses the resistive axis on the high impedance side of the Smith chart 315 multiple times over the plotted frequency range.

Accordingly, FIGS. 2A–3B illustrate that the apparent impedance of the segment feeding a single patch antenna element may be changed from the low impedance side of the Smith chart (FIG. 2B) to the high impedance side of the Smith chart (FIG. 3B) by changing the segment length. As will be described in detail below, impedance may be maximized if this additional segment length B-C is an odd-integer multiple of one-quarter of the wavelength of the desired signal propagating through the feed network.

Exemplary Feed Network for Multiple-Element Patch Antennas

In one example, two patch antenna elements may be fed by two corresponding traces that are each of length A-C and are designed to propagate signals in parallel. The ends of each of these parallel traces (i.e., at C) intersect to form a node (or an electrical junction). A single common trace also intersects the node. The node may be designed such that the power in a signal propagating on the common trace is split substantially equally between the two parallel traces. As an illustrative example, the apparent impedance of each parallel trace changes as a function of the distance from the patch antenna element. Starting from one of the patch antenna elements and moving along the trace connected to that element, the apparent impedance changes until a point is reached at which the apparent impedance is resistive. In this example, the apparent impedance corresponds to crossing the resistive axis on the Smith chart. In particular, this may correspond to crossing the resistive axis on the low impedance side of the Smith chart. If this trace were extended, this low impedance point would recur every half-wavelength of additional trace length.

For simplicity, the first low impedance point may be selected to determine the first component (A-B) of the parallel trace. To this distance may be added the second component (B-C). The second component may be selected as any convenient odd integer multiple of one-quarter wavelength. By adding odd integer multiples of one-quarter wavelength to the length of the trace, the apparent impedance will fall on the resistive axis in the high impedance half of the Smith chart.

In a practical antenna system, joining two or more traces at a node may require that the second length (B-C) be extended to a minimum length such that all of the traces can reach the node. The minimum required length of (B-C) depends on various design constraints, including keep-out areas around patch elements, the physical placement and size of patch elements, and the wavelength of the signal as it propagates along the traces. Wavelength of the propagating signal is influenced by the dielectric of the circuit board substrate (i.e., relative permittivity).

Alternatively, the above-described procedure using the Smith chart may be described in terms that are more physical. Each parallel segment may be designed to have a predetermined length such that, for a desired wavelength of a signal that propagates in parallel through the segments, the signal forms in each segment a standing wave in which a maximum value of the peak voltage amplitude occurs at the common node. The point at which the value of the peak voltage amplitude is maximum may also be referred to as a high impedance point. Also connected to the common node may be a common segment. This common segment may be interconnected such that the power of a signal that propagates along the common segment is split substantially equally among each of the parallel segments.

In one embodiment, the predetermined length of each parallel segment is the sum of 1) a minimum length at which the minimum value of the peak voltage amplitude occurs in a standing wave of the desired wavelength, and 2) an additional length that is an odd integer multiple of one-quarter of the desired wavelength. According to the above-described methods, the impedance of each parallel trace may be maintained at a relatively high value.

Figure 4:
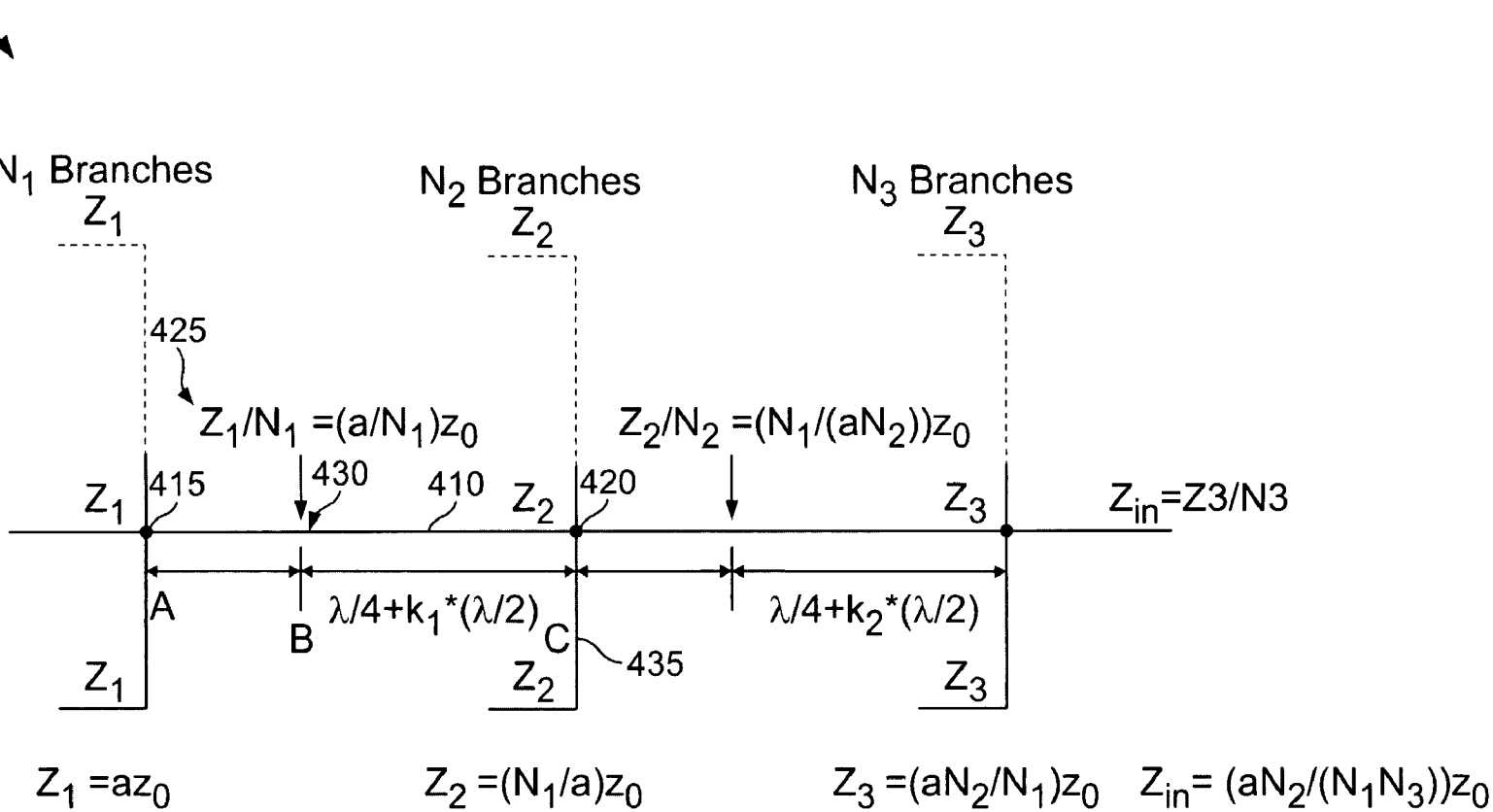
FIG. 4 is a schematic diagram representing impedance matching relationships in a feed network for a multi-element patch antenna.

In FIG. 4, a hierarchical distribution structure 405 for a feed network is designed to exhibit high impedance and low reflection losses. The structure 405 includes segments connected at nodes in the network. Impedance relationships are defined for the segments in the structure 405. The relationships indicated illustrate how impedances relate across each node for variable numbers N1, N2, N3 (i.e., 2, 3, 4, . . . ) of branches. The structure may be extended to any practical number of levels of hierarchy, including 1, 2, 3 (as shown in this example), or more. Each segment that is a common segment to a node has a characteristic impedance and a length as illustrated in FIG. 4.

One aspect of the design of the structure 405 is impedance matching at the nodes. At each node, a common segment is split into two or more parallel segments (each parallel segment has the same impedance). For impedance to be matched at the node, the common segment must have a characteristic impedance that matches the parallel combination of the impedances of the parallel segments. For example, if a common segment splits at a node into four parallel segments, the impedance of that common segment may be set to the impedance of one of the parallel segments divided by four. This applies for the operating frequency or frequencies of interest.

The length of the segments between nodes is determined by the impedance along the segment. For example, the segment (A-C) 410 connects between a node 415 and a node 420. The segment 410 has a characteristic impedance determined by an expression 425 for $Z_1/N_1$ at a low impedance point (B) 425. The length of the segment B-C from point 430 to the Node 420 is formed to be a quarter wavelength plus an integer multiple k1 (=0, 1, 2, . . . ) of one-half wavelength. In this example, the value of $k_1$ may be a function of a practical length required for the segment 410, a parallel segment 435, and any other parallel segments (if provided) to reach the node 420. Each of the parallel segments (e.g., 410, 435) may have substantially the same impedance and substantially the same length.

At each node in the feed network, the impedances may be designed to be substantially matched to minimize signal reflections. As such, maximum power of a propagating signal may be transferred substantially equally to or from parallel segments. In various embodiments, for example, the feed network may be matched to a transmission line of characteristic impedance of, for example, 50 Ohms, 75 Ohms, or other practical impedance value. By selecting lengths that are odd-integer multiples of one-quarter wavelength longer than the minimum length of trace at which the apparent impedance reaches a minimum value (i.e. the peak of the voltage of the standing wave is at a local minimum), a higher apparent impedance can be obtained. The higher apparent impedance may enable direct coupling to a higher impedance transmission line. If the apparent impedance were not designed to be relatively high, the parallel combination of two or more segments would result in a low impedance structure that would not be well matched.

Accordingly, the apparent impedance at successive nodes in a hierarchical feed network can be maintained at a relatively high level by making the transmission line segments between nodes to have particular lengths. For example, the apparent impedance may be configured to be greater than 100 ohms, or between 10 and 100 Ohms, or preferably about 50 Ohms or about 75 Ohms. In other examples, the apparent impedance at a node may be between 25 and 90 Ohms, or between 40 and 60 Ohms, in various configurations. These illustrative examples are representative of typical transmission line impedance values using conventional circuit board systems, and are not meant to be limiting. The principles described herein may also be applied to feed networks in which the apparent impedances may be less than 10 Ohms or more than 100 Ohms. In any case, the apparent impedance of any node in a feed network may be maintained at a relatively high value. These principles may simplify matching of parallel combination of feed network segments to practical impedance levels, such as the characteristic impedance of widely used 50 Ohm or 75 Ohm transmission line systems. Accordingly, improved impedance matching may, in turn, reduce signal reflections and thereby enable improved bandwidth for a multi-element patch antenna system.

Exemplary Feed Network for 3×3 Array

Figure 5:
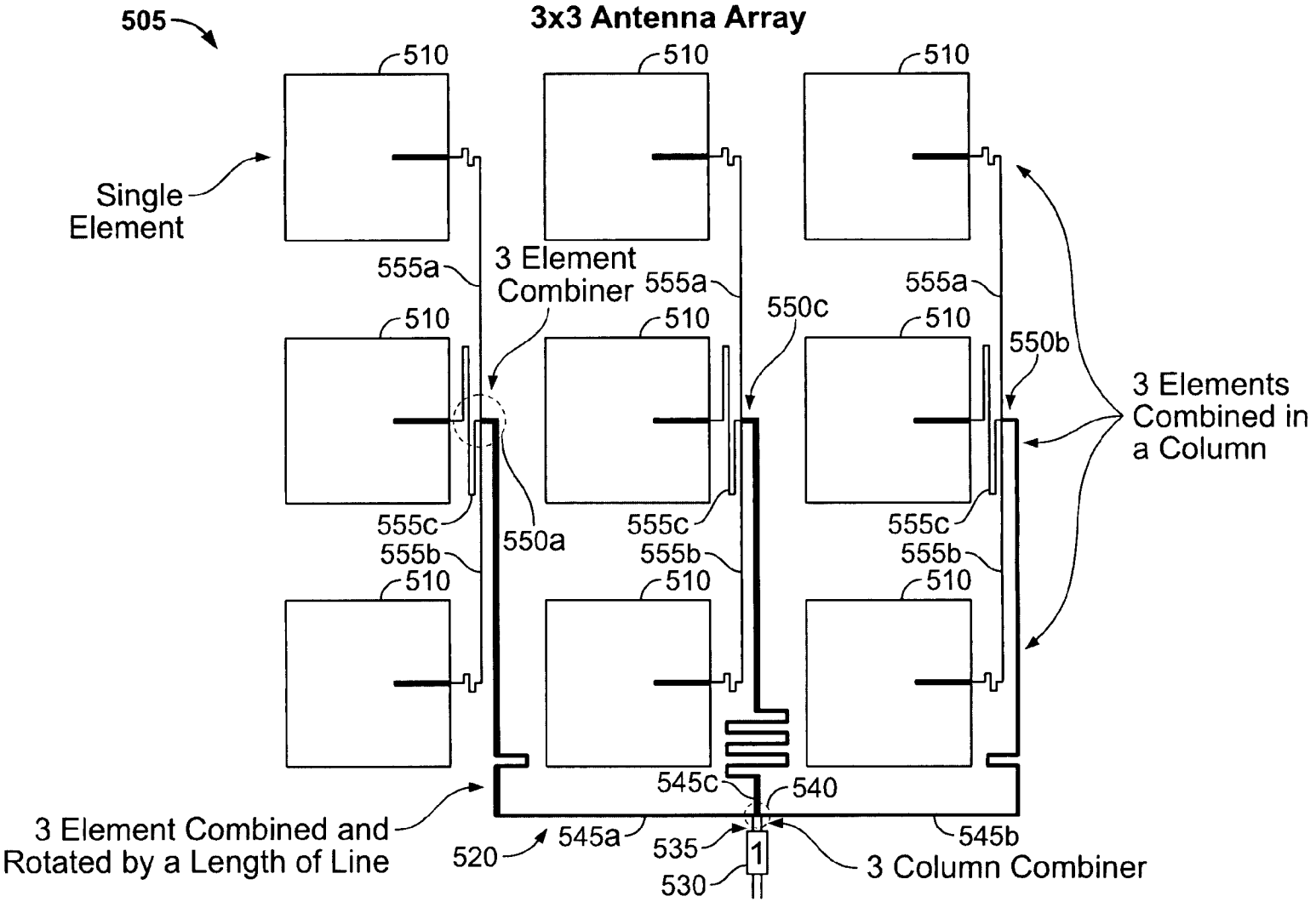
FIG. 5 is a layout diagram of a 3×3 antenna array coupled to a feed network.

An exemplary feed network for a 3×3 patch antenna 505 is shown in FIG. 5. The patch antenna array 505 has nine elements (i.e. patches) 510. Each element 510 is directly coupled to a segment of a feed network 520. The feed network 520 is coupled to a connector 530 through a conductive segment 535. The connector 530 may provide connectivity to transmit or receive circuitry (not shown).

For purposes of description, the feed network 520 may be described from the perspective of either transmitter or receiver operation. However, the principles of reciprocity apply, and it will be understood that the feed network 520 is bi-directional and can perform in both transmit and a receive modes.

In the case of a transmit signal, the feed network 520 may be designed to distribute a propagating signal from the connector 530 through a hierarchical distribution network of transmission line segments in the feed network 520. Within each level of the hierarchy, parallel segments may be designed to have equal impedances. As such, parallel segments of the hierarchical distribution network may have substantially similar width and length to produce substantially similar electrical characteristics.

In the example of FIG. 5, the feed network 520 includes a 3-column combiner node 540 that is electrically connected to the connector 530 through the conductive segment 535. At the 3-column combiner node 540, the feed network 520 splits into three segments, namely two side segments 545*a* and 545*b*, and a center segment 545*c*. The three-column combiner node 540 is shown in more detail in FIG. 12.

Segments 545*a*–545*c* each have substantially equal width and length, and each terminates at a 3-element combiner node 550*a*, 550*b*, and 550*c*, respectively. The three-element combiner node 550 is shown in more detail in FIG. 11. At each of the 3-element combiner nodes 550*a*–550*c*, the respective segments 545*a*–545*c* each split into three traces 555*a*, 555*b*, and 555*c*. Each of the traces 555*a*–555*c* has substantially equal length and width, and connects to a different one of the patch elements 510.

Accordingly, the 3×3 array 505 of patch antenna elements 510 is configured to be fed by the feed network 520 as three groups of three adjacent columns of patch elements 510.

In some embodiments, a multi-element patch antenna feed network may include a hierarchical structure including two or more levels of segments that intersect at a number of common nodes. Starting from the patch antenna element, the feed network may include, for example, two levels of segments, as shown in FIG. 5. Segments between nodes at succeeding levels of the hierarchy may be designed according to the above-described methods, i.e. to have lengths such that the impedance of the network may be maximized, and such that impedances can be substantially matched at each node.

If, for example, the segments 555*a*–555*c* are designed to have the maximum practically achievable impedance (e.g., according to conventional design rules), then the common segment 545 may be designed to have an impedance that is matched to the impedance of the parallel combination of the segments 555*a*–555*c*. As such, the common segment 545 will have an apparent impedance that is one-third the apparent impedance of each of segments 555*a*–555*c* taken individually at the node 550. In some examples, the impedance of segments of the network may only match the impedance of the transmission line that couples the feed network 520 to transmit or receive circuitry at the first node in the hierarchy, which is the node 540 in this example.

In another embodiment, a multi-element patch antenna feed network includes one or more groups of electrically conductive segments. Each group may include a plurality of segments that are each connected at one end to a different one of the patch antenna elements and are each connected at an opposite end to a corresponding common electrical node associated with that group. Each segment in that group has a predetermined length such that, for a desired wavelength of a signal that propagates in parallel through the segments in that group, the signal forms in each segment a standing wave in which a maximum value of the peak voltage amplitude occurs at the common node associated with that group. Each common node includes an electrically conductive common segment. Each common segment is connected at one end to the common node of a different one of the groups. Each common segment is interconnected such that a signal that propagates along the common segment is split substantially equally among each of the segments in the corresponding group.

In some embodiments, each element in the multi-element patch antenna may be connected to one segment of the feed network. In one example, each of three patch elements may each be connected to three corresponding feed network trace segments. The patch elements and the trace segments may each be attached to a dielectric substrate and formed by conductive structures on a circuit board or flex circuit.

Bandwidth Performance

In general, a high impedance feed network may be used to obtain advantages including increased bandwidth for the multi-element patch antenna system. In an illustrative example, the feed network 520 for the 3×3 patch antenna 505 designed in accordance with the methods described herein has apparent impedance characteristics as plotted on the Smith charts of FIGS. 6–10. The steps of the method may be described with reference to these Smith charts and the feed network 520 of FIG. 5.

Figure 6:
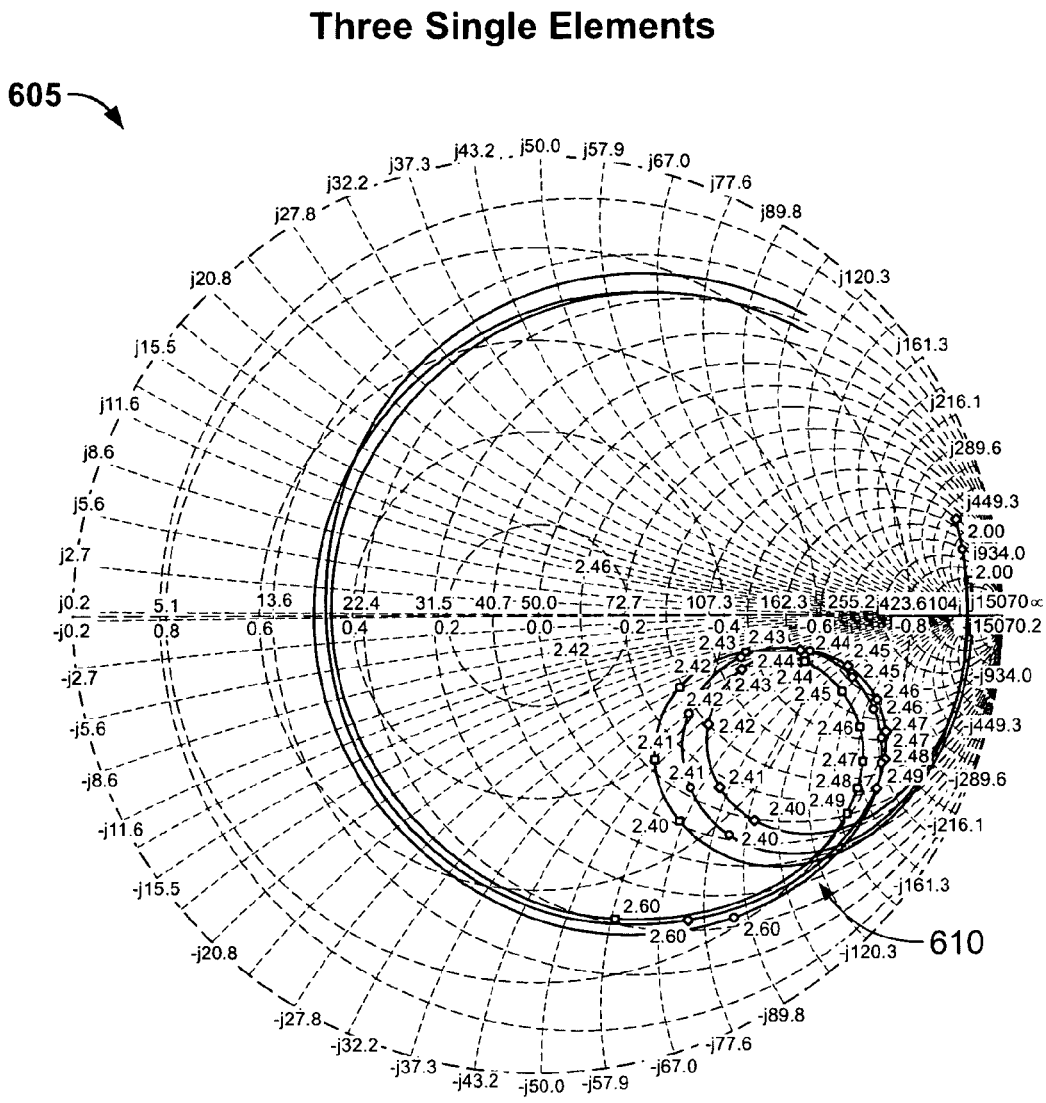
FIG. 6 is a Smith chart plot showing the complex impedances of each of three parallel segments connected to respective single patch antenna elements of FIG. 5.

Beginning with FIG. 6, a Smith chart 605 includes a plot 610 of the apparent impedance of each of the three parallel segments 555*a*–555*c* in one of the columns of elements 510. Each of the three curves in the plot 610 represents the complex impedance over a range of frequencies for one of the segments 555. The impedance represents the complex impedance at the node 550 for each segment 555 independently, as if the node 550 were disconnected from all other segments. The frequencies plotted in this example include frequencies in the range of 2.38 GHz–2.58 GHz. The plot 610 is generally located in the high impedance side of the Smith chart for most of the plotted frequency range.

Figure 7:
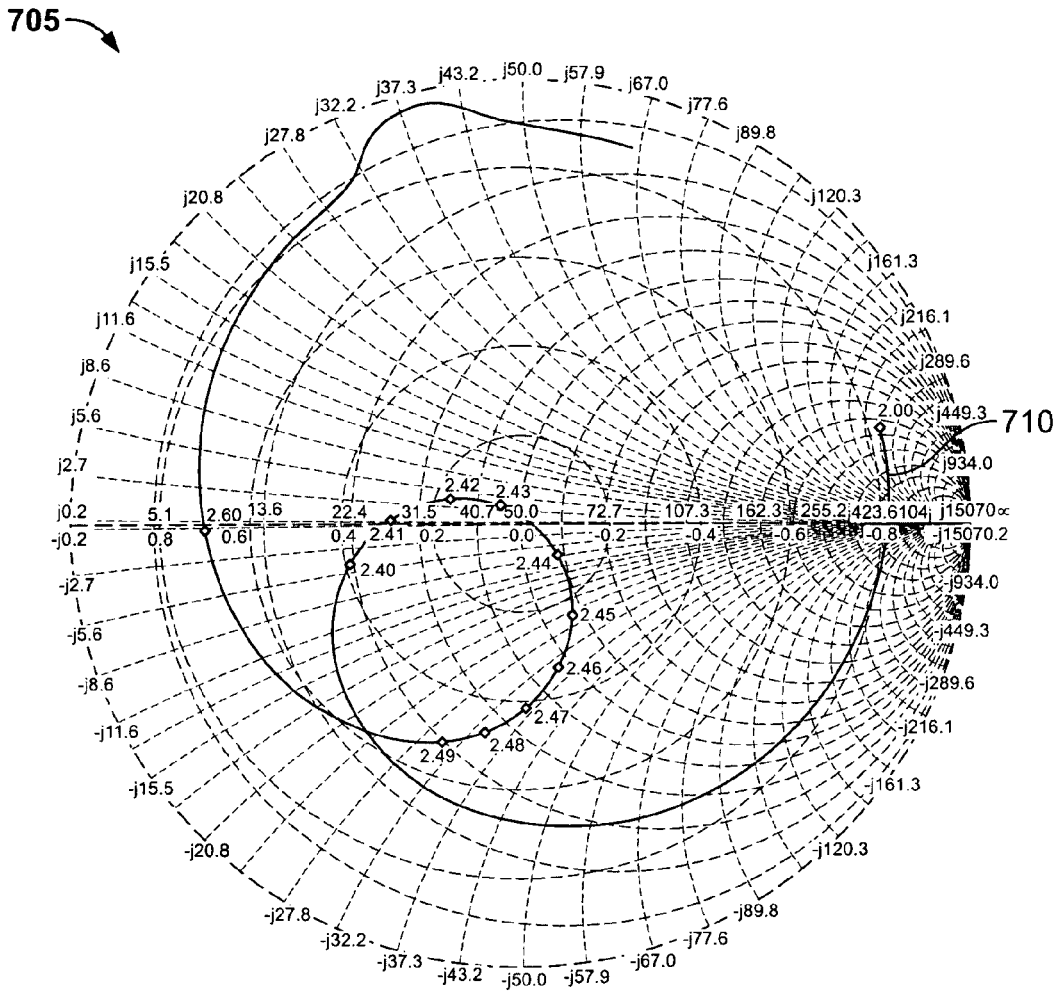
FIG. 7 is a Smith chart plot showing the complex impedance of the three parallel segments of FIG. 6 combined in a column.

In FIG. 7, a Smith chart 705 includes a single plot 710 of the complex impedance at the node 550 including the parallel combination of the segments 555*a*, 555*b*, and 555*c*. The plot 710 has shifted from the plot 610, in that it is generally located in the low impedance side of the Smith chart for most of the plotted frequency range. This impedance reduction is associated with impedances of the three segments 555*a*–555*c* being in parallel.

Figure 8:
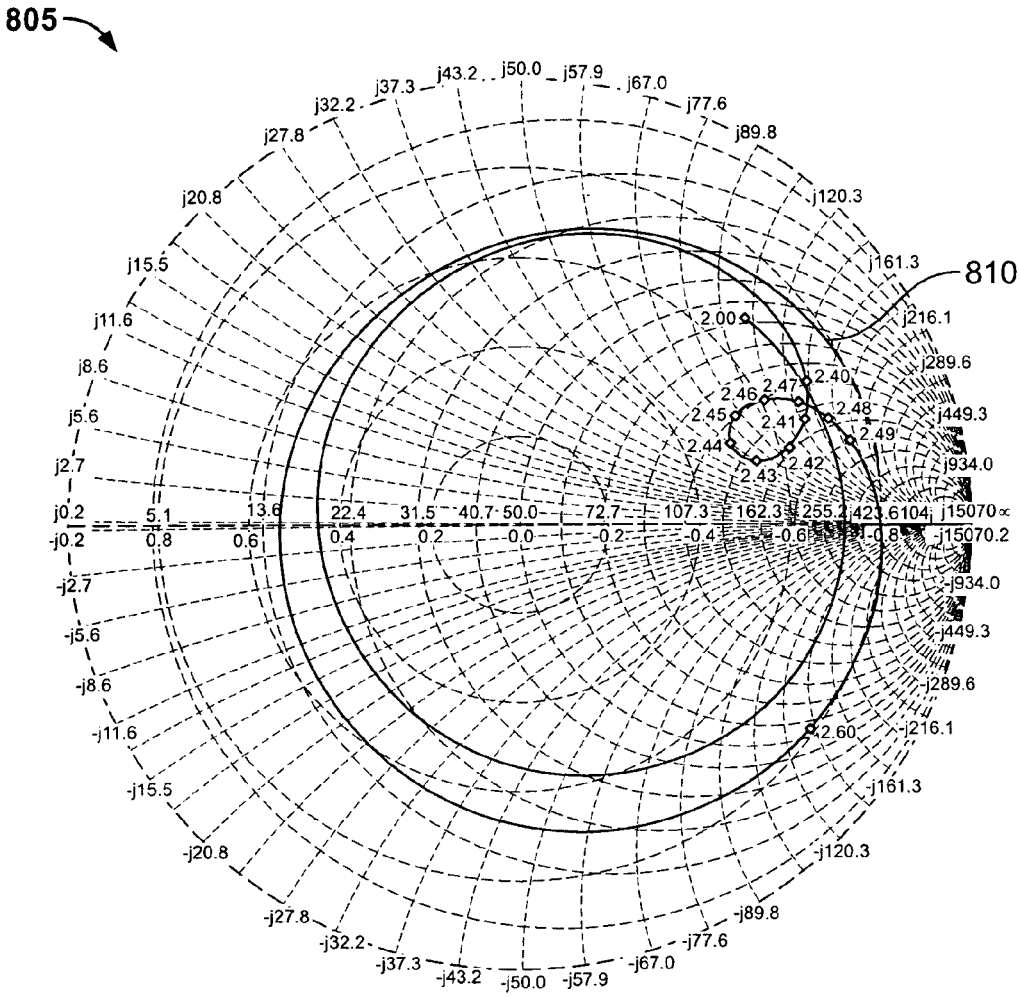
FIG. 8 is a Smith chart plot showing the complex impedance of three parallel segments combined in a column of FIG. 7 and with a high impedance length of transmission line.

In FIG. 8, a Smith chart 805 includes a single plot of the complex impedance of a segment 545 taken at the node 540. In this example, the segment 545 has been extended approximately one-quarter wavelength (based on the center frequency near 2.44 GHz). Accordingly, the plot 810 has been effectively rotated halfway around the Smith chart with respect to the plot 710, and now generally falls on the high impedance side for most of the plotted frequency range. As such, the apparent impedance of a single segment 545 at the node 540 is increased near the center frequency (i.e., between 2.40 and 2.46 GHz, in this example).

Figure 9:
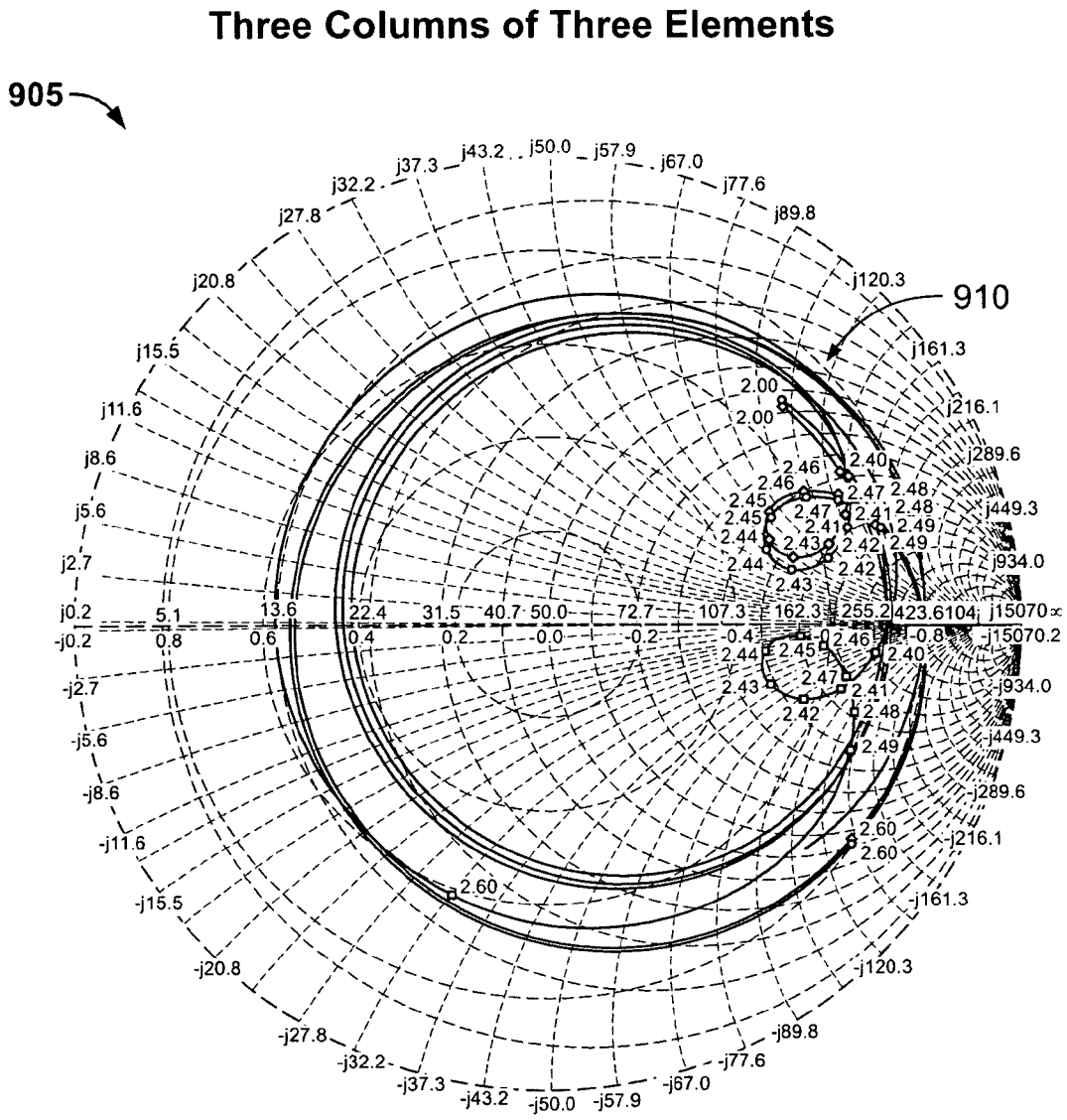
FIG. 9 is a Smith chart plot showing the complex impedances of each of the three parallel columns of FIG. 8.

In FIG. 9, a Smith chart 905 includes a plot 910 of the apparent impedance of each of the three parallel segments 545*a*, 545*b*, and 545*c*. Each of the three curves in the plot 910 represents the complex impedance over a range of frequencies for one of the segments 545. The impedance represents the complex impedance at the node 540 for each segment 545*a*–545*c* independently, as if the node 540 were disconnected from all other segments.

Figure 10:
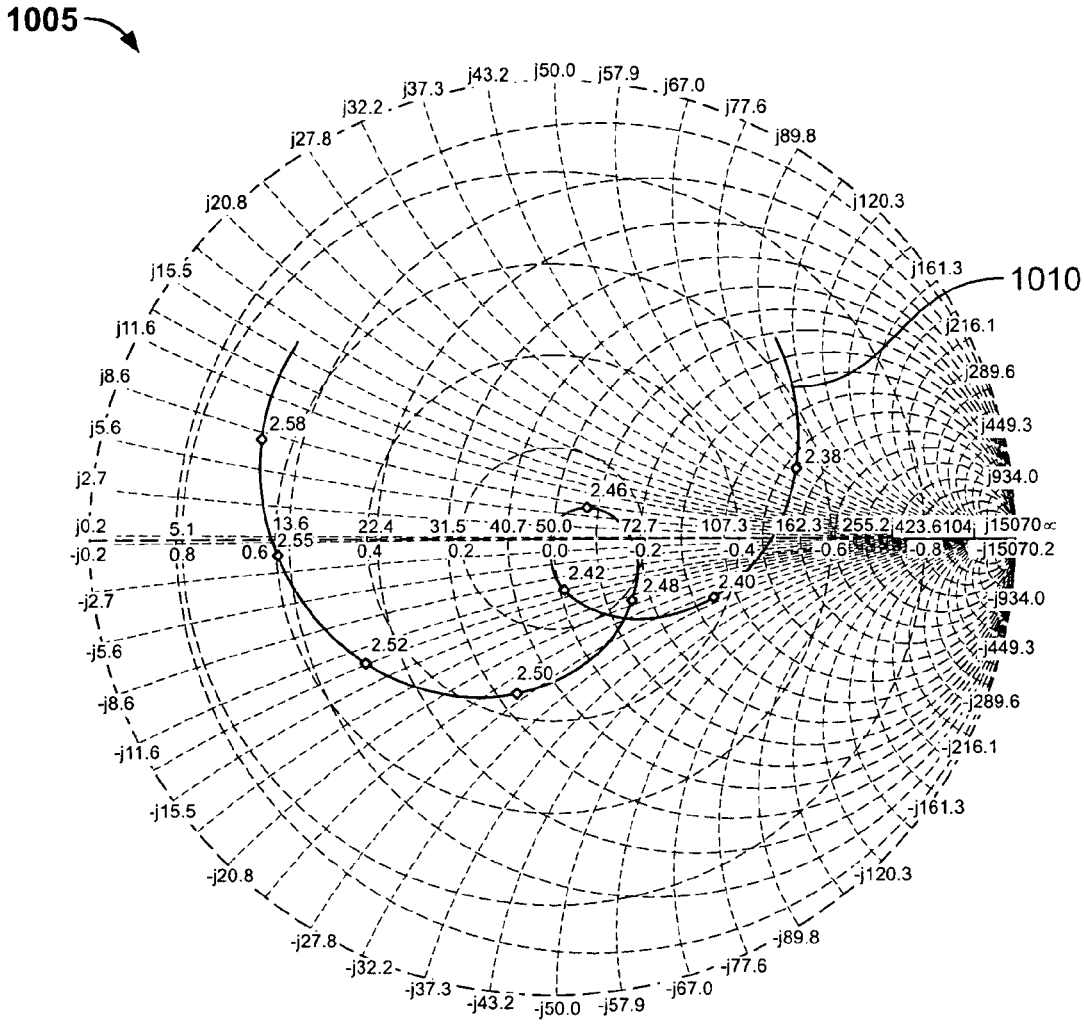
FIG. 10 is a Smith chart plot showing the performance of the feed network with the combination of the three parallel columns of FIG. 9.

In FIG. 10, a Smith chart 1005 includes a single plot 1010 of the complex impedance at the node 540 including the parallel combination of the segments 545*a*, 545*b*, and 545*c*. Relative to the plot 910, the plot 1010 has shifted toward the low impedance side of the Smith chart 1005. As such, the plot 910 is generally located near the center of the Smith chart for most of the plotted frequency range. For points that fall close to the center of the Smith chart, impedance is well matched to the reference impedance, $Z_o$, and the reflection coefficient is low.

In this example, the impedance plot 1010 for the feed network 520 falls within the 0.2 reflection coefficient circle for most of the frequencies between about 2.42 GHz and 2.48 GHz. Accordingly, the bandwidth of the system (including the antenna elements 510 and the feed network 520) may perform well over this range of frequencies because the reflection coefficient is relatively low. This relatively low reflection coefficient over this relatively wide range of frequencies indicates that the antenna system may exhibit a relatively wide bandwidth.

Design of Nodes (Junctions)

In general, a node refers to an electrical junction at which a signal that propagates along a single conductive path may be split to propagate along two or more conductive paths. As used herein, a signal split may refer to a bi-directional structure in which conductive segments in a feed network are arranged so that signals will split in a substantially balanced way as they propagate from a transmitter to the antenna, or combine in a substantially balanced way as they propagate from the antenna to a receiver circuit.

Figure 11:
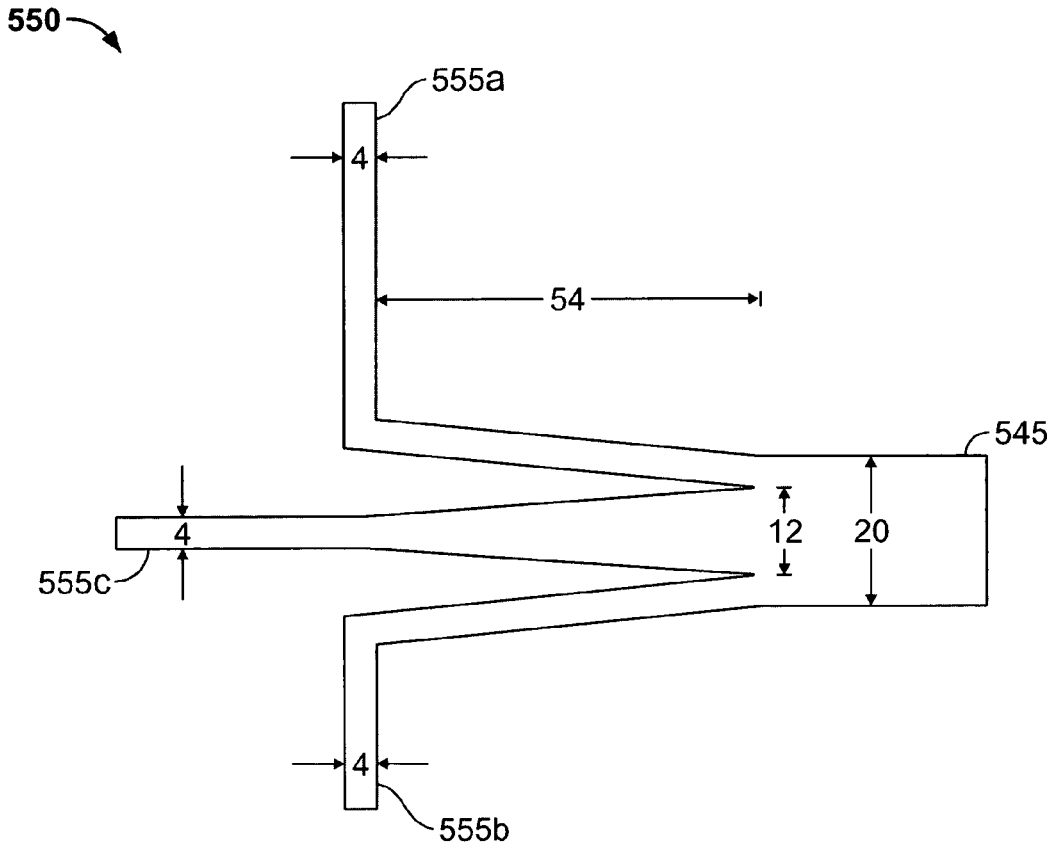
FIG. 11 is an enlarged view showing details of an exemplary three-element combiner node in the feed network of FIG. 5.

For the exemplary feed network 520 of FIG. 5, an exemplary layout for the traces is shown in FIG. 11. In FIG. 11, the 3-element combiner node 550 of FIG. 5 includes an exemplary layout showing how the common segment 545 may be split into the three parallel segments 555*a*–555*c*. Three traces 555*a*–555*c*. The outer segments 555*a* and 555*b* have substantial symmetry, including substantially the same trace width and symmetric geometric layout. However, the central segment 555*c* intersects the segment 545 with a widened trace width. The dimensions of these segments may be designed using commercially available electromagnetic field simulator software. The design may be such that the power of a signal that propagates along the segment 545 is split substantially equally among each of the segments 555*a*–555*c*. For example, the central segment 555*c* may intersect the segment 545 with a wider cross-section to increase the electric field coupling in order to balance the magnetic coupling (due to current density distribution) received by the outer segments 555*a*, 555*b*.

After a relatively short transition portion, the widths of segments 555*a*–555*c* are made substantially equal; in this case, the trace width is made approximately 4 mils wide.

Similarly, the lengths (not shown) of the segments 555*a*–555*c* are made substantially equal from their respective patch antenna elements to the point of intersection with the segment 545 at the node 550. Referring back to FIG. 5, the length of each segments 555 may be made substantially equal to corresponding segments 555 in adjacent columns of antenna elements 510. As such, the feed network 520 may have substantial symmetry with respect to features that determine the impedance of the feed network 520.

Figure 12:
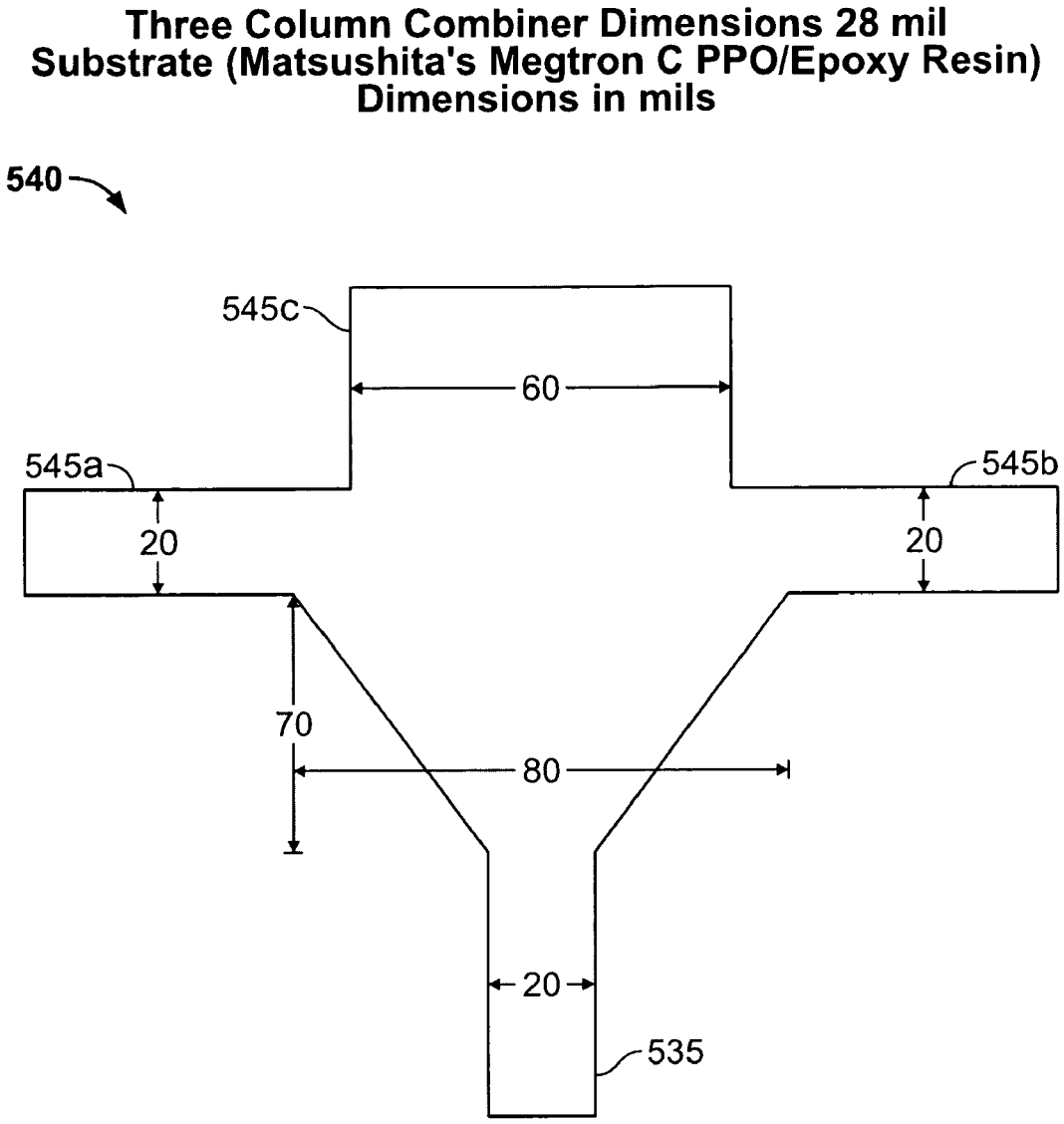
FIG. 12 is an enlarged view showing details of an exemplary three-column combiner node in the feed network of FIG. 5.

An exemplary embodiment of the 3-column combiner 540 of FIG. 5 is shown in FIG. 12. Similar to the 3-element combiner 550 in FIG. 11, three traces 545*a*–545*c* split from the segment 535. The outer segments 545*a* and 545*b* have substantial symmetry, including substantially the same trace width and symmetric geometric layout. However, the central segment 545*c* intersects the segment 535 with a widened trace width. The dimensions of these segments may be designed using commercially available electromagnetic field simulator software. The design may be such that a signal that propagates along the segment 535 is split substantially equally among each of the segments 545*a*–545*c*. For example, the central segment 545*c* may intersect the segment 535 with a wider cross-section to increase the electric field coupling in order to balance the magnetic coupling (due to current density distribution) received by the outer segments 545*a*, 545*b*. In this case, the portion of segment 545*c* would be narrowed over a relatively short distance (not shown) so that the width of most of the segment 545*c* would be substantially the same as the width of segments 545*a* or 545*b*.

In various embodiments, the conductive structures of a multi-element patch antenna feed network may be produced on a dielectric by various commercially used techniques that may include, for example, processes such as lithography, material deposition, and etching. Other methods may include depositing conductive material on less conductive substrate materials. Conductive materials may include, for example, metals, such as copper or gold, conductive inks, silicon, or doped silicon materials. Some or all of the conductive segments of the feed network may be incorporated into an integrated circuit package, hybrid module, or other package, in addition to or instead of a PCB, for example. In one embodiment, a junction node of the feed network may include a single trace on a PCB and a contact coupled to a hybrid module, RF circuit component, or integrated circuit device that couples the single trace to multiple segments.

In another embodiment, a node of the feed network may be implemented as a component having one port for coupling to transmit and receive circuitry, and two or more ports for coupling to a patch antenna elements. Such a feed network may be designed in accordance with the methods described herein to maximize impedance for increased bandwidth of the patch antenna system.

A number of embodiments of the invention have been described. Nevertheless, it will be understood that various modifications may be made without departing from the spirit and scope of the invention. For example, the described feed network may be used with a multi-element patch antenna for transmission, reception, or both. As a further example, the feed network may be operated at frequencies from about 100 MHz to frequencies above 50 GHz. Accordingly, other embodiments are within the scope of the following claims.

What is claimed is:

1. An electrical network for coupling transmit or receive circuitry to a multi-element patch antenna, the electrical network comprising:

a first group of electrically conductive segments in which each segment is connected at one end to a different one of the patch antenna elements and is connected at an opposite end to a common electrical node, wherein each segment has a predetermined length designed such that, for a desired wavelength of a signal that propagates in parallel through the segments, the signal forms in each segment a standing wave in which a maximum value of the peak voltage amplitude occurs at the common node; and a second electrically conductive segment that is connected at one end to the common node and that is formed such that a signal that propagates along the second segment is split substantially equally among each of the segments in the first group.

2. The electrical network of claim 1, wherein the predetermined length of each segment in the first group is the sum of 1) a minimum length at which the minimum value of the peak voltage amplitude occurs in a standing wave of the desired wavelength, and 2) a length that is an odd integer multiple of one-quarter the desired wavelength.

3. The electrical network of claim 1, wherein each of the electrically conductive segments of the first group and the electrically conductive second segment each comprise a conductive trace.

4. The electrical work of claim 3, wherein the conductive traces and patch antenna elements are attached to a print circuit board.

5. The electrical network of claim 3, wherein the conductive traces and patch antenna elements are attached to a flexible dielectric substrate.

6. The electrical network of claim 3, wherein the first group of segments comprises three segments.

7. The electrical network of claim 6, wherein the segments are sized and positioned such that a signal propagating in the second segment splits substantially equally among the three segments.

8. The electrical network of claim 7, wherein a middle one of the three segments is wider than the other two segments.

9. The electrical network of claim 8, wherein a signal that propagates along the second segment is coupled from the second segment to the middle one of the three segments primarily by electric field coupling.

10. The electrical network of claim 9, wherein a signal that propagates along the second segment is coupled from the second segment to the other two of the three segments primarily by magnetic field coupling.

11. The electrical network of claim 1, wherein the lengths of each of the segments in the first group are substantially equal.

12. The electrical network of claim 1, further comprising:

one or more additional groups of electrically conductive segments, each additional group comprising a plurality of segment that are each connected at one end to a different one of the patch antenna elements and are each connected at an opposite end to a corresponding common electrical node associated with that additional group, and wherein each segment in that additional group has a predetermined length such that, for a desired wavelength of a signal that propagates in parallel through the segments in that additional group, the signal forms in each segment a standing wave in which a maximum value of the peak voltage amplitude occurs at the common node associated with that additional group; and one or more additional electrically conductive segments uniquely corresponding to each one of the additional groups of segments, wherein each additional segment is connected at one end to the common node corresponding to that additional group and formed such that a signal that propagates along the additional segment in that additional group is split substantially equally among each of the segments in that additional group.

13. A multi-element patch antenna receiver system comprising the electrical network of claim 1.

14. A multi-element patch antenna transmitter system comprising the electrical network of claim 1.

15. A multi-element patch antenna system comprising the electrical network of claim 1 and having a bandwidth of 200 MHz at 2.44 GHz.

16. A multi-element patch antenna system comprising the electrical network of claim 1 and being characterized by about 12 dBi directivity and about 7 dBi gain for an array of 3×3 elements having a 45 degree beamwidth.

17. A patch antenna comprising:

multiple patch antenna elements;

an electrical network to couple the patch antenna elements to transmit or receive circuitry, the electrical network comprising:

a first group of electrically conductive segments in which each segment is connected at one end to a different one of the patch antenna elements and is connected at an opposite end to a common electrical node, wherein each segment has a predetermined length designed such that, for a desired wavelength of a signal that propagates in parallel through the segments, the signal forms in each segment a standing wave in which a maximum value of the peak voltage amplitude occurs at the common node; and a second electrically conductive segment that is connected at one end to the common node and that is formed such that a signal that propagates along the second segment is split substantially equally among each of the segments in the first group.

18. The patch antenna of claim 17, wherein the predetermined length of each segment in the first group is the sum of 1) a minimum length at which the minimum value of the peak voltage amplitude occurs in a standing wave of the desired wavelength, and 2) a length that is an odd integer multiple of one-quarter the desired wavelength.

19. The patch antenna of claim 17, wherein each of the electrically conductive segments of the first group and the electrically conductive second segment each comprise a conductive trace.

20. The patch antenna of claim 19, wherein the conductive traces and patch antenna elements are attached to a printed circuit board.

21. The patch antenna of claim 19, wherein the conductive traces and patch antenna elements are attached to a flexible dielectric substrate.

22. The patch antenna of claim 19, wherein the electrical network is designed to provide a characteristic impedance to the transmit or receive circuitry of about 75 Ohms.

23. The patch antenna of claim 19, wherein the electrical network is designed to provide a characteristic impedance to transmit or receive circuitry of between about 50 and about 75 Ohms.

24. The patch antenna of claim 19, wherein the electrical network is designed to have an impedance that is maximized using conventional printed circuit board design limits for trace-to-trace spacing and trace width.

25. The patch antenna of claim 24, wherein the conventional printed circuit board design limits comprise a minimum trace width of about 0.004 inches.

26. The patch antenna of claim 24, wherein the conventional printed circuit board design limits comprise a minimum trace-trace spacing of about 0.006 inches.

27. The patch antenna of claim 17, wherein the bandwidth of the antenna is at least 100 MHz.

28. The patch antenna of claim 27, wherein the multiple patch antenna comprise four elements.

29. The patch antenna of claim 28, wherein the four elements are each coupled to a different one of the segments in the first group.

30. The patch antenna of claim 17, further comprising second and third electrical networks, the second and third electrical networks each comprising:

a first group of electrically conductive segments in which each segment is connected at one end to a different one of the patch antenna elements and is connected at an opposite end to a common electrical node, wherein each segment has a predetermined length designed such that, for a desired wavelength of a signal that propagates in parallel through the segments, the signal forms in each segment a standing wave in which a maximum value of the peak voltage amplitude occurs at the common node; and a second electrically conductive segment that is connected at one end to the common node and that is formed such that a signal that propagates along the second segment is split substantially equally among each of the segments in the first group.

31. The patch antenna of claim 30, wherein the multiple patch antenna elements comprise nine antenna elements.

32. The patch antenna of claim 31, wherein the nine elements are interconnected such that a first group of three antenna elements is coupled to the electrical network, a second group of three elements is coupled to the second electrical network, and a third group of three elements is coupled to the third electrical network.

33. The patch antenna of claim 30, wherein the second electrically conductive segments in each of the electrical networks are designed to have a predetermined length that is the sum of 1) a minimum length from the common node in that electrical network at which a minimum value of the peak voltage amplitude occurs in a standing wave of the desired wavelength, and 2) a length that is an odd integer multiple of one-quarter the desired wavelength.

* * * * *